US005816089A

United States Patent [19]

Marando

[11] Patent Number: 5,816,089

[45] Date of Patent: Oct. 6, 1998

[54] HYDROFORMING APPARATUS HAVING IN-DIE HOLE PIERCING CAPABILITIES AND A SLUG EJECTION SYSTEM USING HYDROFORMING FLUID

[75] Inventor: Richard A. Marando, Bernville, Pa.

[73] Assignee: Dana Corporation, Toledo, Ohio

[21] Appl. No.: 756,793

[22] Filed: Nov. 26, 1996

[51] Int. Cl.[6] ..... B21D 28/28; B21D 26/02

[52] U.S. Cl. ..... 72/55; 72/427; 83/54

[58] Field of Search ..... 72/54, 55, 328, 72/427; 83/53, 54

[56] References Cited

U.S. PATENT DOCUMENTS

| | | |
|---|---|---|
| 2,182,744 | 12/1939 | Ehrsam . |
| 2,976,754 | 3/1961 | Wennes . |
| 3,524,368 | 8/1970 | Goldman . |
| 3,939,743 | 2/1976 | Coombes . |
| 4,989,482 | 2/1991 | Mason ..... 72/55 |
| 5,111,723 | 5/1992 | Andrusch et al. . |
| 5,398,533 | 3/1995 | Shimanovski et al. . |
| 5,435,163 | 7/1995 | Schafer . |
| 5,460,026 | 10/1995 | Schafer . |

*Primary Examiner*—David Jones

*Attorney, Agent, or Firm*—MacMillan, Sobanski & Todd

[57] ABSTRACT

A hydroforming apparatus having in-die hole piercing capabilities and a slug ejection system is disclosed. The slug ejection system uses the pressurized hydroforming fluid as the motive force to eject the slug of material created by the in-die hole piercing system. The in-die hole piercing system includes a movable punch disposed within a bore formed in one of the die blocks. The bore opens into the die cavity. The punch includes a cutting edge on a first end which is adjacent the cavity. The hole is formed when the punch is inserted against a hollow workpiece positioned in the apparatus, thereby creating a slug of material. The slug ejection system includes two passageways formed internally to the same die block having the in-die hole piercing system. Both passageways open into and extend in a generally transverse direction to the bore. A first passageway is in fluid communication with the source of the hydroforming fluid. A second passageway is located generally opposite the first passageway and functions as a chute to catch the slug of material ejected by the hydroforming fluid supplied to the first passageway. The hydroforming fluid is supplied to the first passageway only after the workpiece has been hydroformed and remains pressurized and the punch is retracted to a position where it is generally aligned with both passageways.

18 Claims, 8 Drawing Sheets

HYDROFORMING APPARATUS HAVING IN-DIE HOLE PIERCING CAPABILITIES AND A SLUG EJECTION SYSTEM USING HYDROFORMING FLUID

BACKGROUND OF THE INVENTION

This invention relates to an apparatus and method for hydroforming a hollow workpiece into a finished product having a complex shape and at least one hole or opening formed therein. More specifically, this invention relates to a hydroforming apparatus and method which includes in-die hole piercing capabilities and a slug ejection system for removing the slug of material created by the in-die hole piercing. In particular, the slug ejection system uses the pressurized hydroforming fluid as the motive force to eject the slug of material.

Typically, many complex-shaped metallic products are made by welding stamped parts together. The individual parts are first formed by stamping or otherwise cutting specific shapes out of a stock material, typically sheet metal. These individual parts are then welded together along edge flanges to provide the desired final configuration of the product. If the final product requires holes or other openings, the holes may be formed during the stamping process or formed during separate punching or drilling processes. Overall, this manufacturing process can be relatively time-consuming and expensive because of the multiple pieces of equipment and processing steps required for stamping, drilling, and welding the individual pieces.

One manufacturing process which does not include many of the problems associated with the process of welding stamped parts is the process of expansion shaping. The process of expansion shaping, also referred to as "hydroforming", involves placing a deformable, hollow workpiece into a die cavity and then expanding the workpiece into the shape of the die cavity by the application of a pressurized fluid internally within the workpiece. The deformable workpiece is usually a metallic material and may be in the form of tubular stock, square stock, or sheet material. The hydroforming apparatus is similar to a conventional press and typically includes two die halves or blocks which together form a die cavity having a shape and size configured to match the final desired shape and size of the hydroformed product. Hydroforming apparatuses also include sealing and filling devices for sealing the workpiece and supplying the pressurized fluid, respectively.

Often it is necessary that the hydroformed product include various holes and openings for attaching fasteners or other components to the hydroformed part. Accordingly, some hydroforming apparatuses include in-die hole piercing systems for piercing a hole in the workpiece. The in-die hole piercing system may include a movable punch disposed within a bore formed in one of the die blocks. The bore opens into and extends generally transverse to the die cavity. The punch is movable within the bore between an inserted position and a retracted position. The punch has a cutting edge on its end adjacent the workpiece. When the punch is inserted, it cuts into the outer surface of the workpiece, thereby creating a slug of material.

A number of in-die hole piercing systems are known. Some systems use the mechanical shearing force of the punch to create the hole and resulting slug. Other systems pierce the hole simultaneously with the hydroforming step thereby using the pressure of the hydroforming fluid to force the workpiece against the cutting edge of the punch.

Once a hole has been created using an in-die hole piercing system, the resulting slug of material must be removed.

Some slug removal systems and methods for use with an in-die hole piercing system are known. The simplest involves letting the slug fall into the hydroformed finished product and then removing the slug after the finished product has been removed from the hydroforming apparatus. Others involve moving the slug to a location within the hydroforming apparatus where it can be ejected by some ejection mechanism. For example, one known slug removal system pushes a slug with an arm into an ejection chute. In this system, the slug is not removed until the workpiece is depressurized and the slug has fallen due to gravity to a location where it can be pushed by the arm into the ejection chute. Alternatively, this system may use compressed air to blow the slug into the ejection chute. Both of these systems have the disadvantage of requiring the use of additional moving parts and systems not normally used in a hydroforming apparatus (i.e. the movable arm must be moved by a suitable actuator and the compressed air must be supplied by a compressor and associated piping.) Ideally, it would be desirable to use the pressurized hydroforming fluid as the motive force for ejecting the slug of material created by the in-die piercing system so as to minimize the complexity of the hydroforming apparatus.

SUMMARY OF THE INVENTION

This invention relates to a hydroforming apparatus and method which includes an in-die hole piercing system and a slug ejection system. The slug ejection system uses the pressurized hydroforming fluid as the motive force to eject the slug of material created by the in-die hole piercing system.

In general, the hydroforming apparatus includes a pair of die blocks which are movable toward each other between an open position and a closed position. The die blocks form a sealed cavity when in their closed position. The sealed cavity has a shape and size which is configured to match the shape and size of the final hydroformed product. The in-die hole piercing system is disposed within the main die. More specifically, one of the die blocks has at least one bore formed therein which opens into and extends generally transverse to the cavity. A punch is received in the bore and is movable between an inserted position and a retracted position. When the punch is in its inserted position, it contacts the outer surface of a workpiece positioned in the cavity of the hydroforming apparatus. The punch includes a cutting edge on a first end adjacent the cavity for piercing a hole in the workpiece when the punch is inserted sufficiently.

The slug ejection system is also disposed within the main die. The slug ejection system is used for ejecting the slug of material which is created when the hole is made by the in-die hole piercing system. The die block having the bore also has a first passageway and a second passageway formed therein. Both the first and second passageways open into and extend generally transverse to the bore. The first passageway is in fluid communication with a source of hydroforming fluid. The second passageway is located generally opposite the first passageway and functions as a chute to catch the slug of material which is ejected by the pressurized hydroforming fluid supplied to the first passageway.

In operation, a deformable, hollow workpiece is positioned in the hydroforming apparatus and pressurized until it conforms to the shape of the die cavity. Once the workpiece has been hydroformed into the final desired shape, the hole-forming portion of the process is performed. A first end of the hole-forming punch is inserted against the hydroformed workpiece to initiate the cutting of the hole.

Preferably, the punch is advanced to a position where the workpiece is only partially cut. Once this area has been partially cut, the pressure internal to the hydroformed workpiece is reduced to a value below the maximum hydroforming pressure, but above ambient pressure. Next, the punch is retracted within the bore to a position where the edge of the punch does not contact the workpiece. Because of the pressure internal to the workpiece, the partially cut area is forced outward, resulting in a slug of material being formed. The slug of material is forced against the first end of the punch as the punch is retracted due to the pressure internal to the workpiece. When the first end of the punch is generally aligned with the first and second passageways, pressurized hydroforming fluid is supplied to the first passageway. The pressure of the hydroforming fluid within the first passageway combined with the release of pressurized fluid within the workpiece ejects the slug of material into the second passageway.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
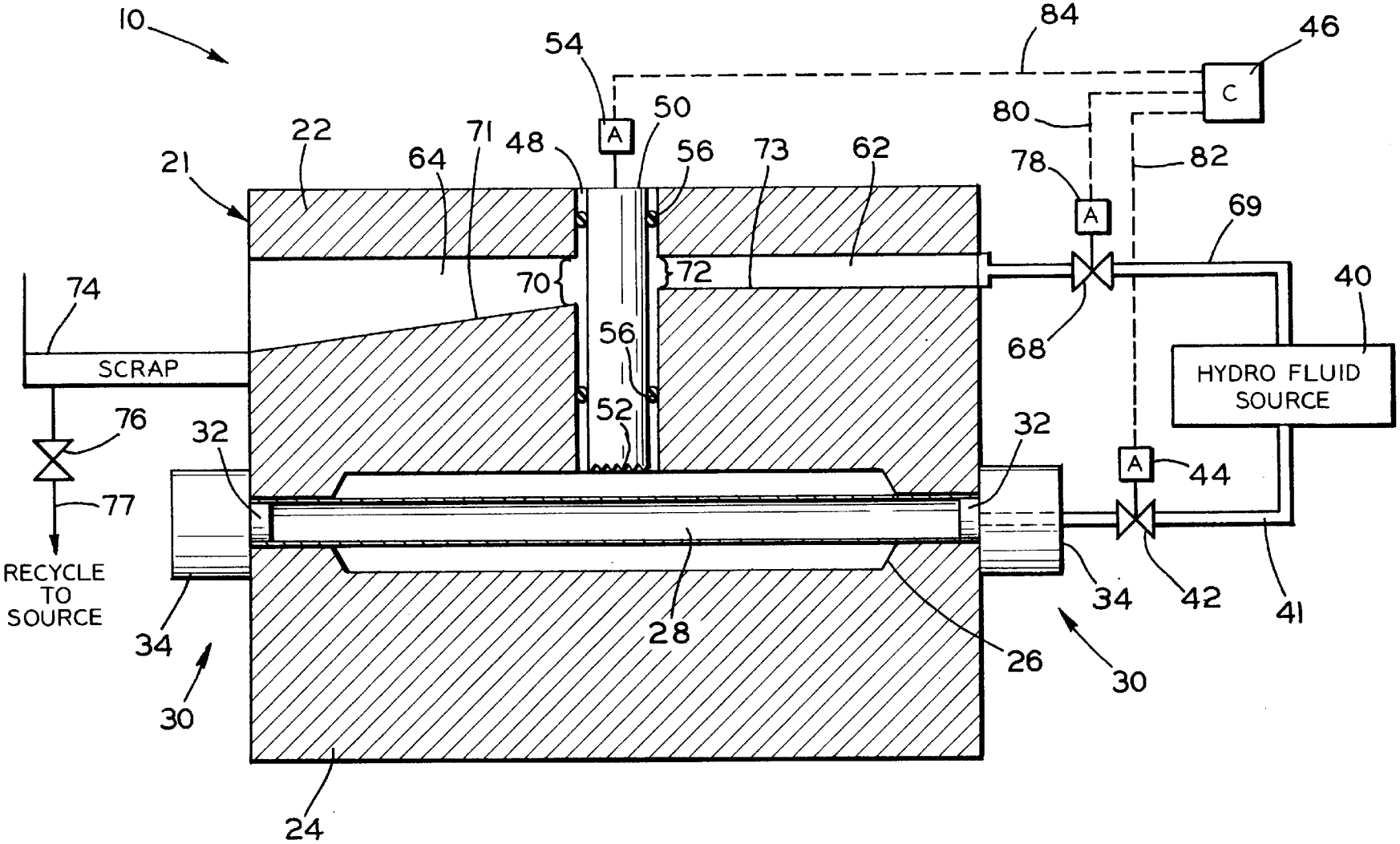
FIG. 1 is a schematic cross sectional view of a hydroforming apparatus having in-die hole piercing and slug ejection systems in accordance with this invention. This figure also shows a hollow workpiece to be hydroformed within the hydroforming apparatus.

Referring now to the drawings, there is illustrated in FIGS. 1 through 6 a hydroforming apparatus, indicated generally at 10, in accordance with the present invention. Hydroforming apparatuses 10 are typically used to deform a hollow, metallic workpiece into a product having a complex shape. The basic structure and mode of operation of hydroforming apparatuses 10 are well known in the art, and only those portions of the hydroforming apparatus 10 which are necessary for a complete understanding of the invention will be described. In general, hydroforming apparatuses use the application of a pressurized fluid internally to the hollow workpiece to create the desired final shape and size of the product. Referring to FIG. 1, the basic structure of the hydroforming apparatus 10 includes a main die, indicated generally at 21, which includes a pair of die halves or blocks. More specifically, the main die 21 may include an upper die block 22 and a lower die block 24. The upper die block 22 and the lower die block 24 are movable toward each other between an open position and a closed position. The pair of die blocks 22 and 24 are shown in the closed position in FIG. 1. Together, the upper die block 22 and the lower die block 24 form a sealed die cavity 26 when they are in their closed positions. The shape and size of the die cavity 26 is configured to match the desired shape and size of the final hydroformed product. While most hydroforming apparatuses 10 include a two-piece sectional die, it should be appreciated that the main die 21 of the hydroforming apparatus 10 may include multiple die blocks as necessary to achieve the desired final shape. In addition, the terms "upper" and "lower" as they are applied to the die blocks 22 and 24 are not limiting in that the blocks 22 and 24 can be reversed or even turned from side to side.

The hollow workpiece to be hydroformed is positioned within the die cavity 26 between the upper die block 22 and the lower die block 24. Typically, a hollow, tubular member, such as the workpiece 28 shown in FIG. 1, is used to make hydroformed products. However, other material such as square stock or sheet metal may be used, provided the die configuration is adapted accordingly. Usually, steel is used to make vehicle frame components. However, any other deformable material such as other metals and plastics may be suitable for use in hydroforming apparatuses and processes.

The process of hydroforming involves the application of a pressurized fluid internally to the workpiece 28. Accordingly, hydroforming apparatuses 10 usually include a mechanism for sealing and filling the workpiece 28. In the illustrated embodiment shown in FIG. 1, a pair of sealing heads, indicated generally at 30, may be used to seal both ends of the workpiece 28. In general, each sealing head 30 may include a piston 32 which is disposed within an end of the workpiece 28. The piston 32 may be fit within the workpiece 28 so as to provide a seal therebetween. Alternatively, a separate sealing mechanism (not shown) may be used to seal the ends of the workpiece 28. Each sealing head 30 may also include an actuator 34. Each actuator 34 displaces a piston 32 towards the other piston and against the ends of the workpiece 28. Typically, the actuator 34 is hydraulically operated. However, other actuators may be used including, but not limited to, other automatic actuators such as pneumatic or solenoid operated actuators, or manual actuators. Other types of sealing heads 30, rams, pistons, mandrels or other mechanisms for sealing and filling a workpiece to be hydroformed are known and may be used with the hydroforming apparatus 10 and method of this invention.

As shown in FIG. 1, one of the sealing heads 30 may be adapted for filling the sealed workpiece 28. Alternatively, both sealing heads may be adapted for filling the workpiece 28. The sealing head(s) 30 used for filling the workpiece 28 may be supplied with a source of hydroforming fluid 40 through an appropriate fluid supply line 41. Optionally, a valve 42 may be used to control the supply of hydroforming fluid to the workpiece 28. The workpiece-hydroforming fluid supply valve 42 may be actuated by any suitable manual or automatic actuator 44 such as those described for actuator 34 above. Optionally, the actuator 44 for the workpiece-hydroforming fluid supply valve 42 may be electrically connected to a controller 46. The controller 46 may be embodied as a conventional microprocessor or similar computing apparatus which can be programmed to generate one or more electrical output signals in response to a plurality of electrical input signals.

Figure 4:
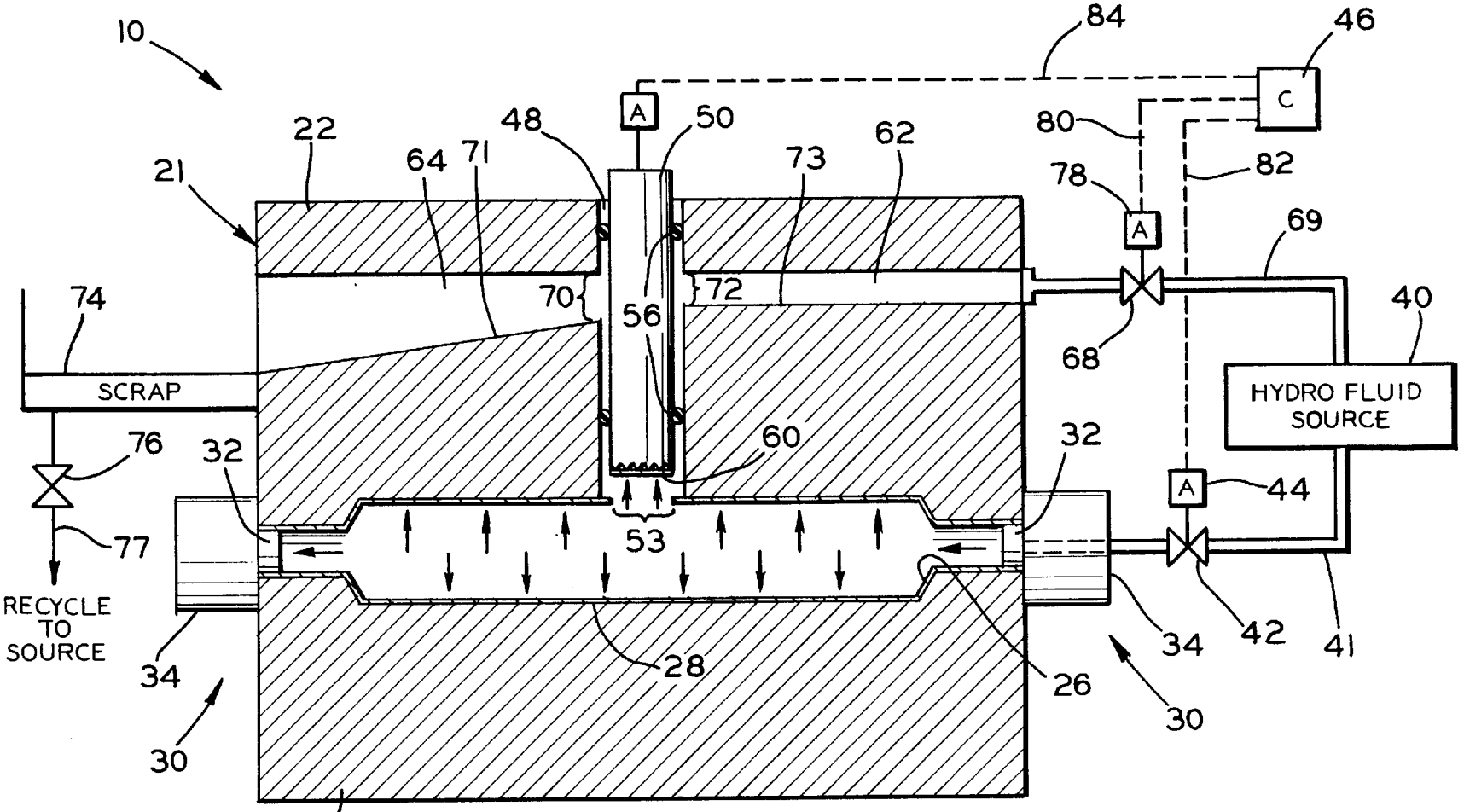
FIG. 4 is the same view of the hydroforming apparatus as shown in FIG. 3 except that this figure shows the formation of a slug of material and the retraction of the in-die hole piercing system.

It may be necessary that the final hydroformed product include holes or other openings for attaching fasteners, brackets, or other components to the product. Accordingly, some hydroforming apparatuses 10 include in-die hole piercing capabilities for forming one or more holes in the workpiece. In the illustrated embodiment, one of the die blocks (the upper die block 22 in the figures) may includes at least one bore 48 formed therein which opens into and extends generally transverse to the die cavity 26. The bore 48 receives a punch 50 which is movable within the bore 48. The punch 50 includes a first end 52 which is adjacent the die cavity 26. The first end 52 is adapted for piercing a hole 53 in the workpiece 28. (A hole 53 which has been formed in the workpiece 28 is best seen in FIG. 4.) The first end 52 may include a cutting edge or other surface suitable for piercing a hole 53 in the workpiece. The first end 52 has a shape and size matching the shape and size of the desired hole 53.

Figure 3:
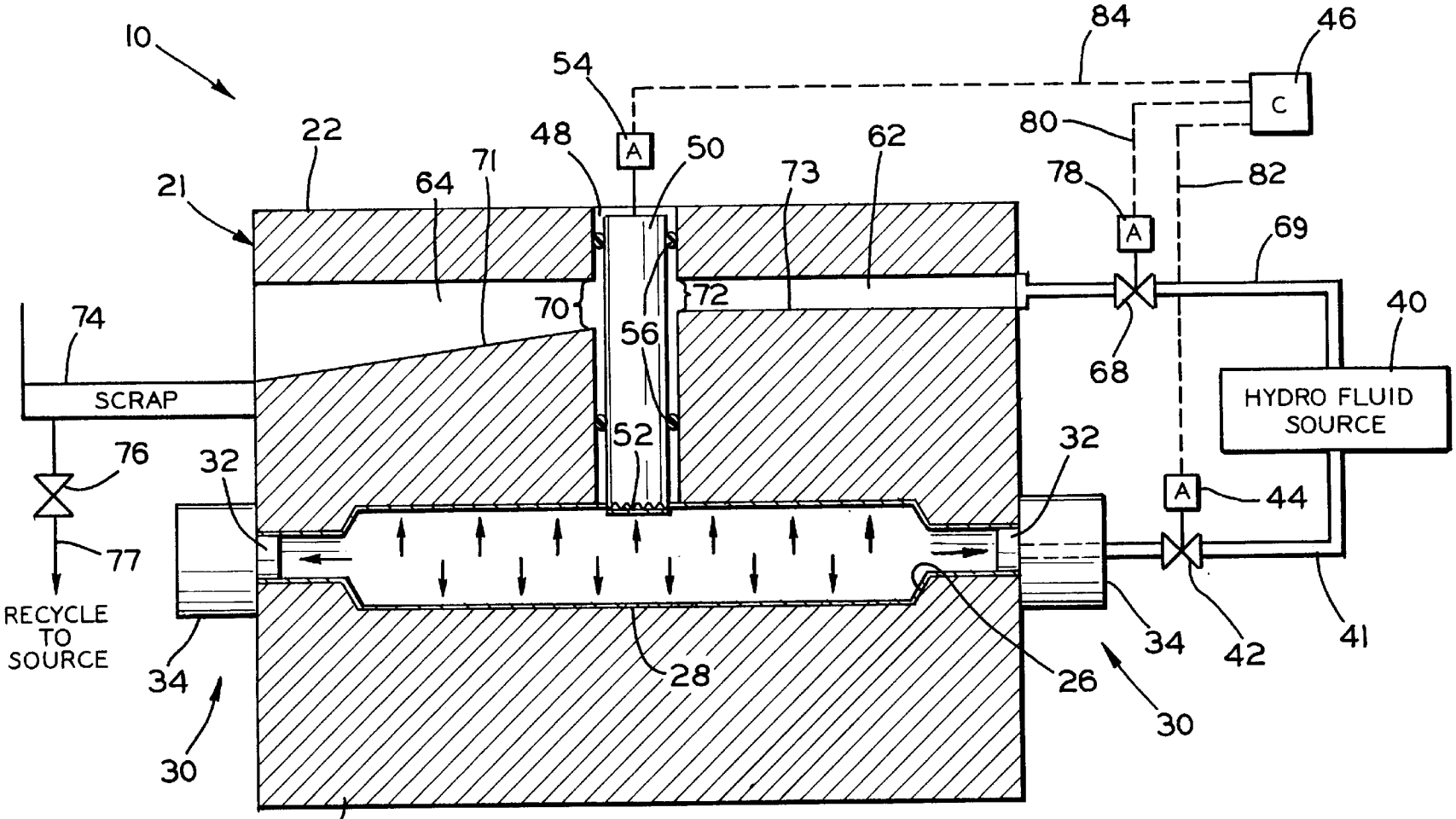
FIG. 3 is the same view of the hydroforming apparatus shown in FIG. 2 except that this figure shows the initial formation of the hole in the hydroformed workpiece.
Figure 5:
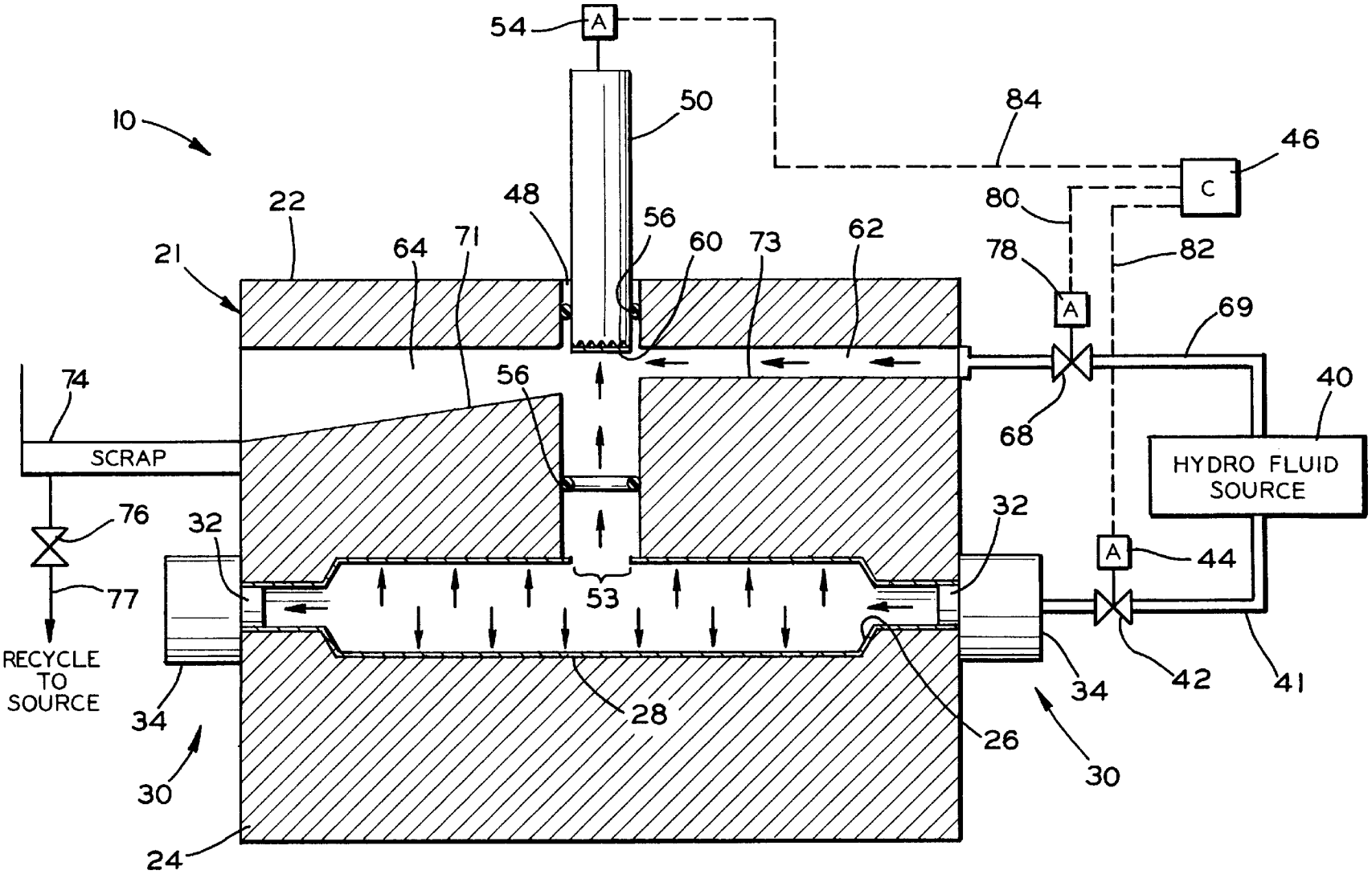
FIG. 5 is the same view of the hydroforming apparatus shown in FIG. 4 except that this figure shows the in-die hole piercing system being retracted to a position where the slug ejection system is actuated to eject the slug of material.
Figure 6:
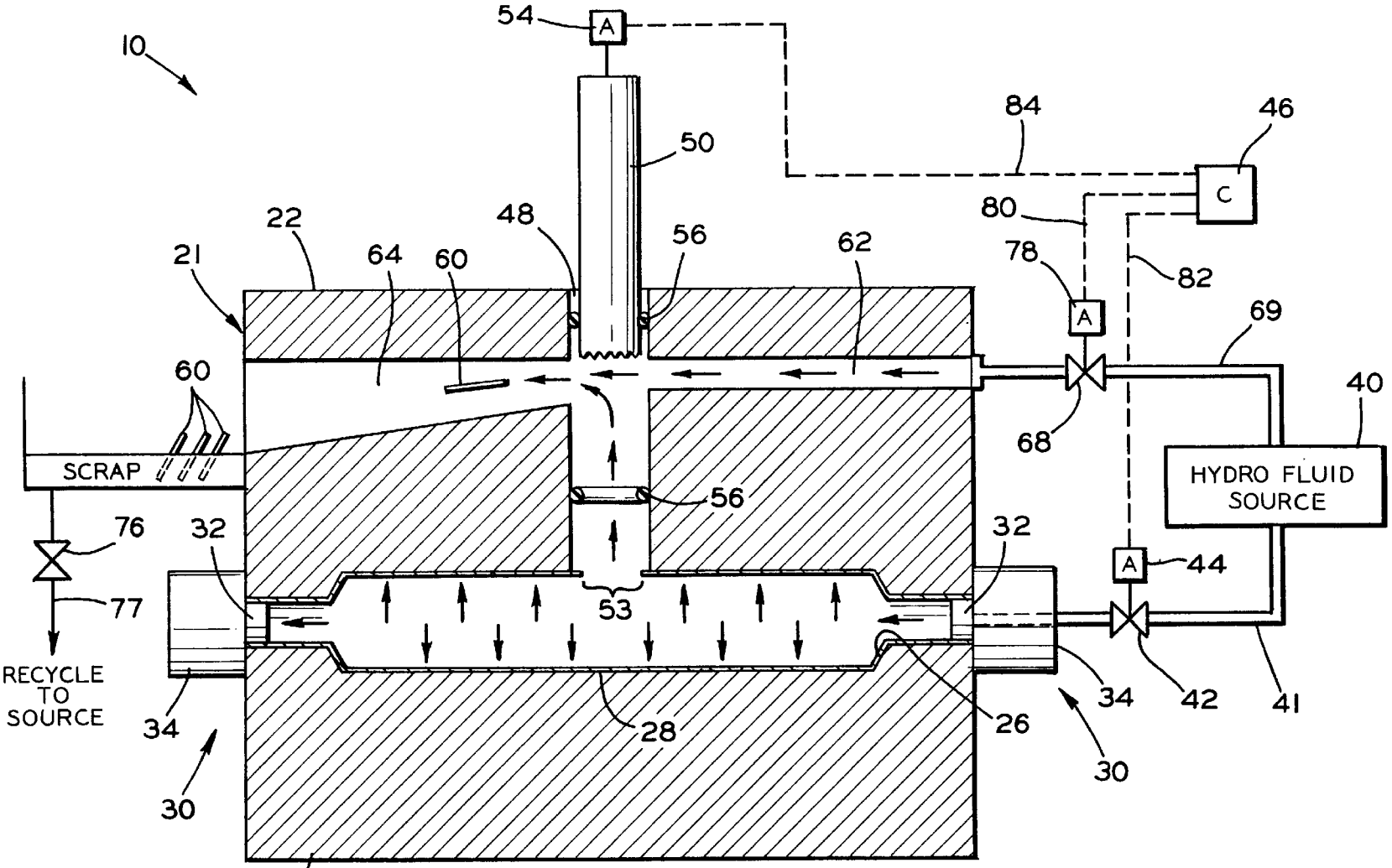
FIG. 6 is the same view of the hydroforming apparatus shown in FIG. 5 except that this figure shows the slug of material being ejected using the slug ejection system.

The punch 50 may be moved within the bore 48 by any suitable actuator 54, including, but not limited to, automatic actuators such as hydraulic, pneumatic, or solenoid-operated actuators or any manually-operated actuator. The punch 50 is movable between an inserted position, which is best seen in FIG. 3 to a retracted position, which is best seen in FIGS. 5 and 6. The punch 50 is also movable through a number of intermediate positions as shown in FIGS. 1 and 4. When the punch is inserted as shown in FIG. 3, the first end 52 contacts the outer surface of the workpiece 28. The punch can be used to partially or completely cut a hole 53 in the wall of the workpiece 28. A sealing mechanism 56 may be required between the punch 50 and the bore 48 since the bore 48 opens into the die cavity 26 and the pressurized fluid within the workpiece 28 may come in contact with the first end 52 of the punch 50 once the hole 53 is formed. The sealing means 56 may be made from any of the known sealing devices including, but not limited to, O-rings and face seals.

Once a hole 53 is cut into the workpiece 28, a separated slug of material 60 will be formed. A slug of material 60 which is separate from the workpiece 28 is shown in FIGS. 4 through 6. Referring to FIG. 1, the illustrated hydroforming apparatus 10 includes a slug ejection system in accordance with this invention. In general, the slug ejection system uses two passageways 62 and 64 formed internally to the hydroforming apparatus 10 and the pressurized hydroforming fluid as the motive force to eject the slug of material 60. More specifically, one of the die blocks (the upper die block 22 in the illustrated embodiment) has a first passageway 62 and a second passageway 64 formed therein. Both the first passageway 62 and the second passageway 64 open into and extend generally transversely to the bore 48. The first passageway 62 is in fluid communication with the hydroforming fluid source 40. Optionally, the hydroforming fluid may be supplied to the first passageway 62 through a first passageway-hydroforming fluid supply valve 68 and appropriate fluid supply line 69. The second passageway 64 is located generally opposite the first passageway 62 with respect to the bore 48. The second passageway 64 is used to receive the slug 60 which is ejected by the pressurized hydroforming fluid flowing through the first passageway 62, as will be discussed in greater detail below. Because the second passageway 64 functions as a chute to catch the ejected slug 60, the second passageway 64 may be configured to have a larger opening 70 into the bore 48 than the opening 72 of the first passageway 62. In addition, the bottom or lower surface 71 of the opening 70 into the second passageway 64 may be located closer to the cavity 26 than the bottom or lower surface 73 of the opening 72 into the first passageway 62. The end of the second passageway 64 opposite the opening 70 may open to a scrap collector 74. Optionally, the scrap collector 74 may be connected to a drain valve 76 and associated piping 77 for recycling the hydroforming fluid back to its source 40.

The first passageway-hydroforming fluid supply valve 68 may be operated by any suitable actuator 78, including but not limited to, automatic actuators such as hydraulic, pneumatic, or solenoid-operated actuators or any manually-operated actuator such as a threaded handwheel operatively connected to the valve body. Additionally, the operation of the first passageway-supply valve 68 may be controlled by the controller 46. Typically, the hydroforming fluid is supplied to the first passageway 62 when it is desired to eject a slug of material 60. Accordingly, the controller 46 may be used to control the timing of the operation of the first passageway-supply valve 68 through signal line 80. In addition, the controller 46 may be electrically connected to the workpiece-hydroforming fluid supply valve actuator 44 and the punch actuator 54 through signal lines 82 and 84, respectively.

Figure 2:
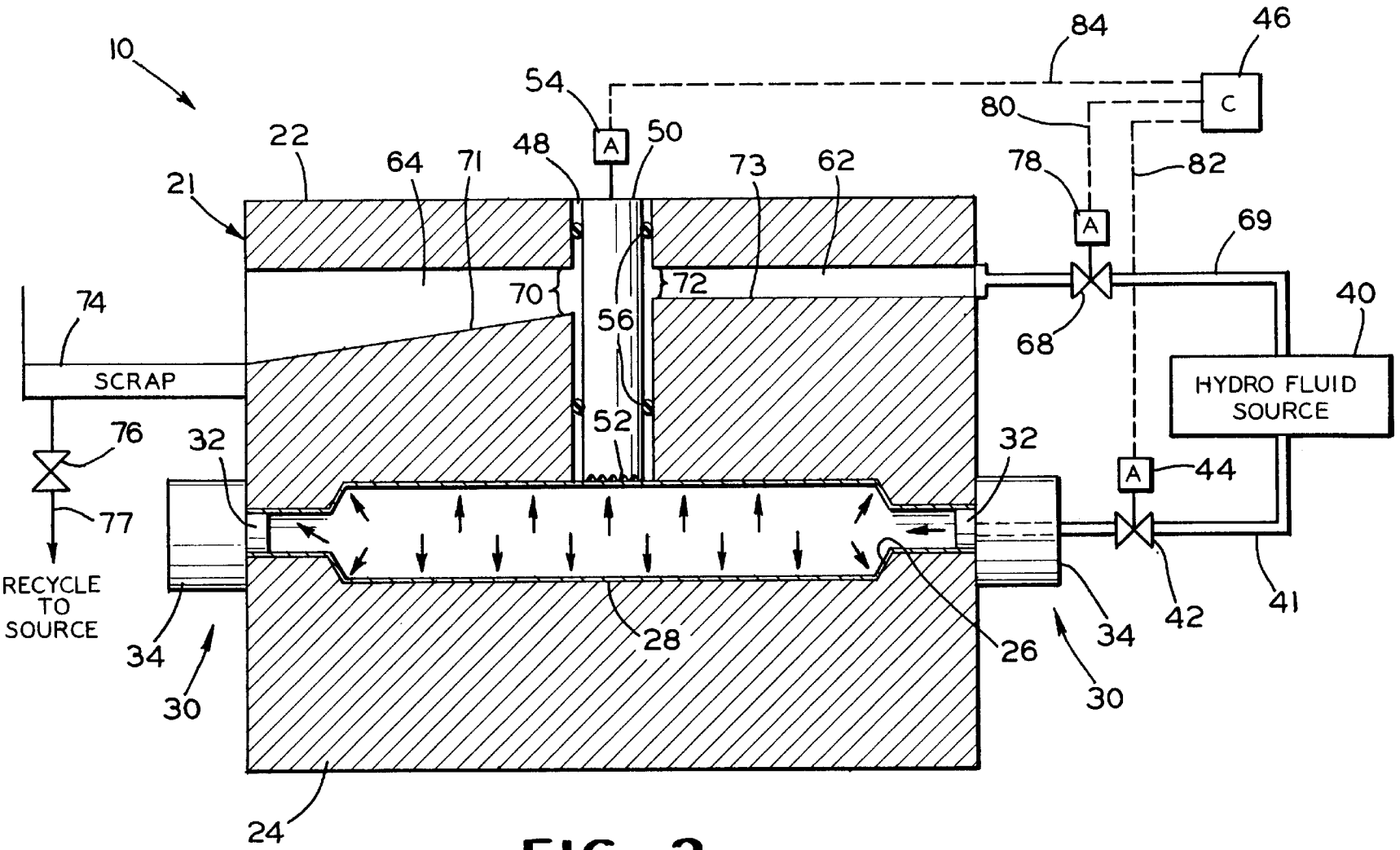
FIG. 2 is the same view of the hydroforming apparatus shown in FIG. 1 except this figure shows the workpiece being hydroformed into its final shape.

In operation, the hydroforming apparatus 10 is initially set up by opening the two die blocks 22 and 24 and then positioning a deformable, hollow workpiece 28 in the cavity 26. The two die blocks 22 and 24 are closed as shown in FIG. 1. Next, the ends of the workpiece 28 are sealed with the pair of sealing heads 30. The workpiece 28 is then filled and pressurized as shown in FIG. 2. As the pressure internal to the workpiece 28 begins to increase, the workpiece 28 is expanded in an outward direction so as to conform with the shape and size of the die cavity 26. (The pressure internal to the workpiece 28 is represented by the outwardly directed arrows.)

Figure 3A:
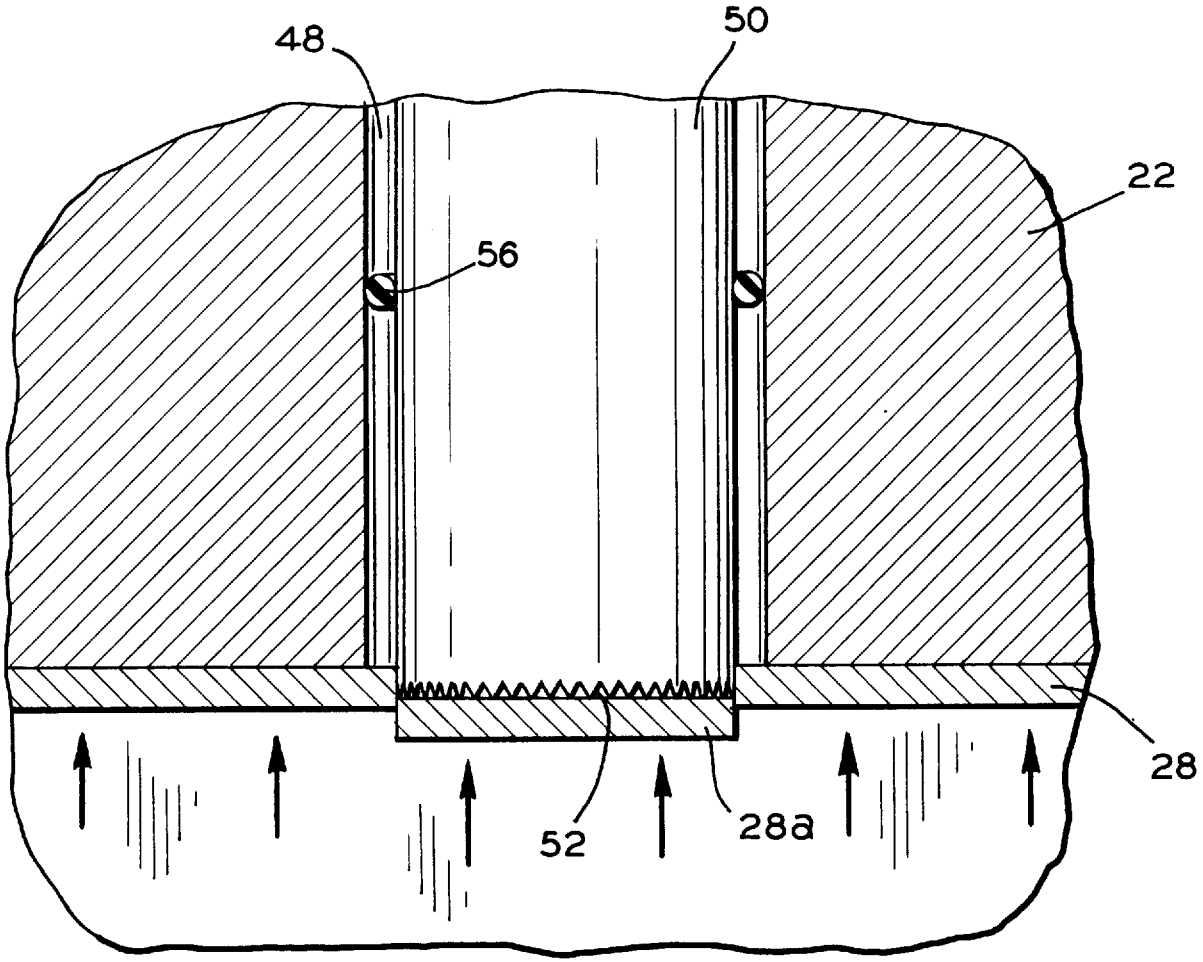
FIG. 3*a* is detailed partial view of the hydroforming apparatus and workpiece shown in FIG. 3.

When the workpiece 28 has fully expanded into the die cavity 26, the hole-forming portion of the process may be performed as shown in FIG. 3. The first end 52 of the punch 50 may be inserted against the hydroformed workpiece 28 to initiate the cutting of the hole 53. Preferably, the punch 50 is advanced to a position where the workpiece 28 is only partially cut or perforated. As shown in FIG. 3*a*, the area 28*a* of the workpiece 28 which has been partially cut by the punch 50 remains attached to the workpiece.

Once the area 28*a* has been partially cut, the pressure internal to the hydroformed workpiece 28 may be reduced to a value below the maximum hydroforming pressure, but above ambient pressure. Next, the punch 50 may be retracted within the bore 48 to a position where the first end 52 of the punch 50 does not contact the workpiece 28. Because of the pressure internal to the workpiece 28, the partially cut area 28*a* is forced outward, resulting in a slug of material 60 being formed.

The slug ejection portion of the process is shown in FIGS. 4 through 6. As the punch 50 is retracted, the slug 60 is continued to be forced against the first end 52 of the punch 50 due to the pressure of the hydroforming fluid. As shown in FIG. 5, the punch 50 may be retracted to a position where the first end of the punch 50 is generally aligned with both the first passageway 62 and the second passageway 64. Preferably, the punch 50 is retracted to a position where the first end 52 of the punch 50 is just immediately above the top portion of the first passageway 62. Next, the pressurized hydroforming fluid is supplied to the first passageway 62 in sufficient volume and pressure so as to eject to the slug 60 into the second passageway 64 as shown in FIG. 6. (The pressurized fluid is represented by the horizontal arrows in FIG. 6.) The combination of the pressurized hydroforming fluid and the pressure internal to the workpiece 28 causes the slug 60 to be ejected into the second passageway 64.

Once the slug 60 is ejected into the second passageway 64, it may be removed by any suitable means. For example, the second passageway 64 may be directly open to a scrap collector 74. Since some of the hydroforming fluid may be ejected out the second passageway 64, it may be desirable to recycle this fluid so as to minimize production costs associated with the product. Accordingly, the hydroforming fluid may be returned to its source 40 using any suitable piping system, such as valve 76 and piping 77. Alternatively, the hydroforming fluid may be discarded.

The first passageway-fluid supply valve 68 may be controlled by a controller 46 to automatically control the supply of hydroforming fluid to the first passageway 62. Optionally, the controller 46 may receive an input signal from the workpiece-fluid supply valve actuator 44 through signal line 82 and an input signal from the punch actuator 54 through signal line 84. In one embodiment of this invention, the controller 46 may be used to open valve 68 so as to supply the pressurized hydroforming fluid to the first passageway 62 and eject the slug 60 when the punch 50 is in its retracted position. In another embodiment, the first passageway-fluid supply valve 68 may be opened by the controller 46 when the workpiece-fluid supply valve 42 is closed and the punch 50 is retracted. Alternatively, the first passageway-fluid supply valve 68 may be opened by the controller 46 when the pressure of the hydroforming fluid supplied to the workpiece 28 is less than the pressure of the hydroforming fluid supplied to the first passageway 62 and the punch 50 is retracted to a position where the slug 60 will be ejected into the second passageway 64.

Figure 7:
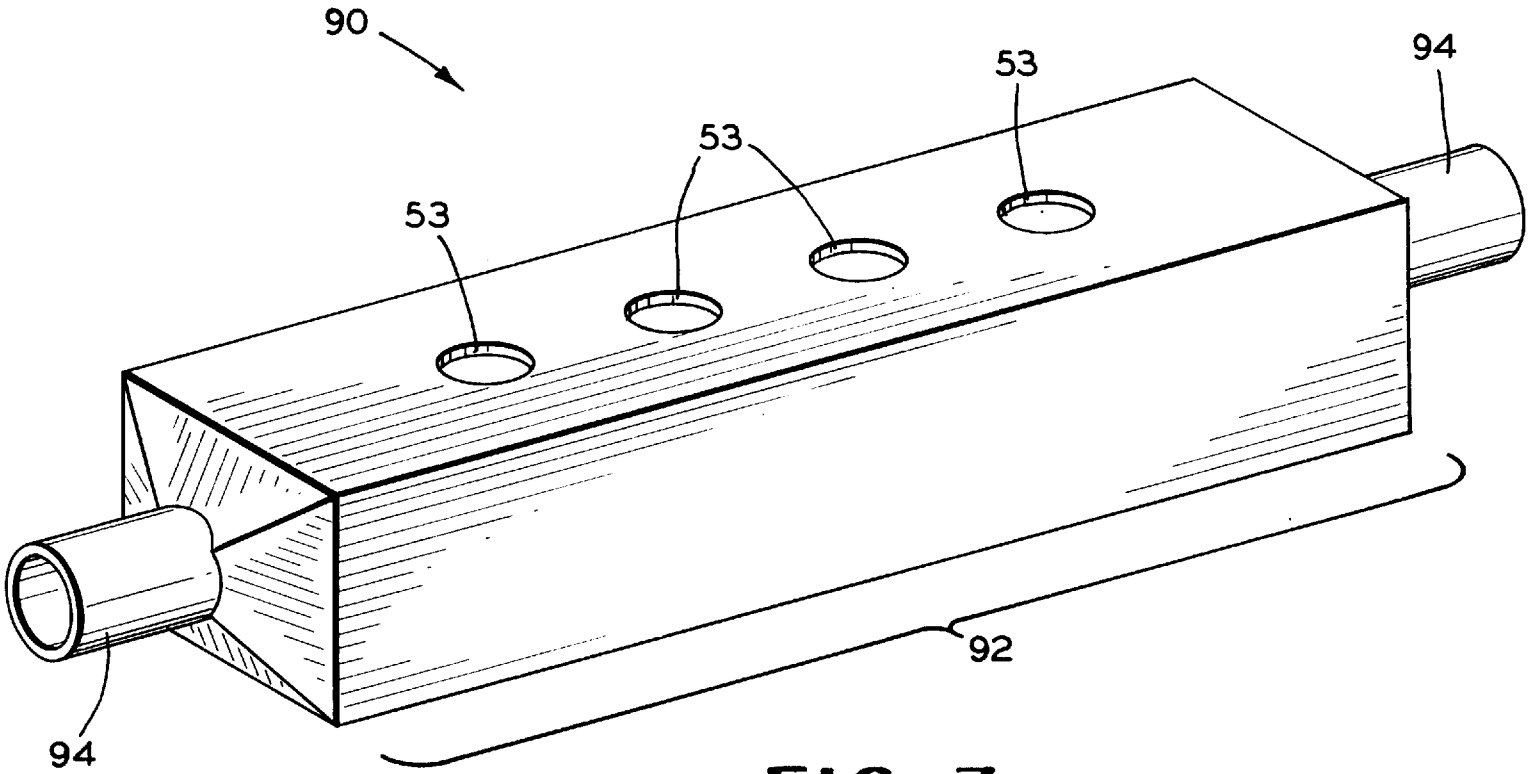
FIG. 7 is a perspective view of a finished vehicle frame component which can be made using the hydroforming apparatus shown in FIG. 1.

One type of product which is well suited for being manufactured using a hydroforming apparatus 10 and process as described previously is a vehicle frame component. Virtually all automobiles and trucks include a frame assembly which serves as a platform on which the remainder of the vehicle is built. Most types of frame assemblies are comprised of several types of frame components including a pair of siderails which may be joined together by one or more cross members. An example of a cross member is shown in FIG. 7 and is indicated generally at 90. As seen in FIG. 7, the cross member 90 has a main portion 92 having a generally rectangular or box-shaped cross section which tapers on each end to end portions 94 having a generally tubular cross section. In addition, the cross member 90 has been manufactured to includes various holes and openings 53 for attaching brackets, fasteners or a vehicle component itself to the cross member 90. The box-shaped main section 92 and the various holes 53 of this particular frame component 90 can be manufactured using the hydroforming apparatus 10 and method described in detail above.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An apparatus for hydroforming a hollow workpiece, said apparatus comprising:

a pair of first and second die blocks movable toward each other between an open position and a closed position, said pair of die blocks forming a sealed cavity therebetween when in said closed position, said first die block having at least one bore formed therein which opens into and extends generally transverse to said cavity, said first die block further having a first passageway and a second passageway formed therein, both of said first and second passageways opening into and extending generally transverse to said bore and being located generally opposite each other with respect to said bore;

at least one punch which is movable within said bore between an inserted position and a retracted position, said punch having a first end adapted for piercing a hole in the workpiece and thereby creating a slug of material, said punch forming said hole and the slug of material when said punch is moved to its inserted position, and said first end of said punch being generally aligned with said first and second passageways when said punch is moved to its retracted position;

a first hydroforming fluid supply system for supplying pressurized hydroforming fluid internally to the workpiece so as to expand the workpiece into conformance with said cavity, wherein the pressurized hydroforming fluid forces the slug of material against said punch as said punch is moved to its retracted position; and a second hydroforming fluid supply system for supplying pressurized hydroforming fluid to said first passageway so as to eject the slug of material when said punch is moved to its retracted position.

2. The apparatus defined in claim 1 wherein said first and second passageways have an opening into said bore and said second passageway opening is larger than said first passageway opening.

3. The apparatus defined in claim 2 wherein a bottom surface of said second passageway opening is located closer to said cavity than a bottom surface of said first passageway opening.

4. The apparatus defined in claim 1 wherein said second passageway is operatively connected to a scrap collector for collecting the ejected slugs.

5. The apparatus defined in claim 1 further including a controller adapted for selectively controlling the supply of hydroforming fluid through said first and second hydroforming fluid supply systems.

6. The apparatus defined in claim 5 wherein said controller is adapted for selectively controlling said movement of said punch.

7. The apparatus defined in claim 6 wherein said controller further includes a program for supplying the hydroforming fluid through said second hydroforming fluid supply system only when said punch is moved to its retracted position.

8. The apparatus defined in claim 6 wherein said controller further includes a program for supplying the hydroforming fluid through said second hydroforming fluid supply system only when i) said punch is moved to its retracted position and ii) the hydroforming fluid supplied through said first hydroforming fluid supply system is at a lower pressure than the hydroforming fluid supplied through said second hydroforming fluid supply system.

9. A method for hydroforming a hollow workpiece, said method comprising the steps of:

(a) providing a hollow workpiece in a hydroforming apparatus, said hydroforming apparatus including a pair of first and second die blocks movable toward each other between an open position and a closed position, said die blocks forming a sealed cavity therebetween when in said closed position, said first die block having at least one bore formed therein which opens into and extends generally transverse to said cavity, said first die block further having a first passageway and a second passageway formed therein, both of said first and second passageways opening into and extending generally transverse to said bore, said first and second passageway being located generally opposite each other with respect to said bore, said bore receiving a punch which is movable between an inserted position and a retracted position, and said punch including a first end adapted for piercing a hole in the workpiece;

(b) supplying pressurized hydroforming fluid internally to the workpiece so as to expand the workpiece into conformance with said die cavity;

(c) inserting said punch to its inserted position so as to form a hole in the workpiece and create a slug of material which is separate from the workpiece;

(d) retracting said punch to its retracted position, the slug of material being forced against said first end of said punch as said punch is retracted due to the pressurized fluid internal to the workpiece; and (e) supplying pressurized hydroforming fluid to said first passageway so as to eject the slug of material into said second passageway.

10. The method defined in claim 9 wherein in step (d), said punch is retracted until said first end of said punch is generally aligned with said first and second passageways.

11. The method defined in claim 9 wherein in steps (c) and (d), said punch is inserted to a position where the workpiece is partially cut and the hole and slug of material are created when said punch is retracted.

12. The method defined in claim 9 further including the step of reducing the pressure of the hydroforming fluid supplied to the workpiece prior to retracting said punch in step (d).

13. The method defined in claim 12 wherein in step (d), said punch is retracted until said first end of said punch is generally aligned with said first and second passageways.

14. A method for making a product having a complex shape and at least one hole formed therein, said method comprising the steps of:

(a) providing a hollow workpiece in a hydroforming apparatus having an in-die hole piercing system;

(b) providing a first passageway and a second passageway in said hydroforming apparatus, said first and second passageway opening into and extending generally transverse to said in-die hole piercing system;

(c) supplying a pressurized hydroforming fluid internally to the workpiece so as to expand the workpiece into the complex shape;

(d) forming a hole in the workpiece using said in-die hole piercing system thereby also forming a separated slug of material, the slug of material being forced against said in-die hole piercing system due to the pressurized fluid internal to the workpiece;

(e) positioning said in-die hole piercing system such that the slug of material forced against said in-die hole piercing system is generally aligned with said first and second passageways; and (f) supplying a pressurized hydroforming fluid to said first passageway so as to eject the slug of material into said second passageway.

15. The method defined in claim 14 further including the step of reducing the pressure of said hydroforming fluid supplied to the workpiece prior to positioning said punch in step (e).

16. The method defined in claim 14 further including the step of preforming a hole in the workpiece using said in-die hole piercing system prior to supplying said hydroforming fluid to said workpiece in step (c).

17. The method defined in claim 14 wherein said hydroforming fluid supplied to the workpiece and said hydroforming fluid supplied to said first passageway are taken from the same source of fluid.

18. The method defined in claim 14 further including the step of collecting said hydroforming fluid from said second passageway.

* * * * *